US007891594B1

(12) United States Patent
Ossome et al.

(10) Patent No.: US 7,891,594 B1
(45) Date of Patent: Feb. 22, 2011

(54) MEDICINE CRUSHER

(76) Inventors: Shivetti Ossome, 4813 Tegan Rd., Elk Grove, CA (US) 95758; Ben Ossome, 4813 Tegan Rd., Elk Grove, CA (US) 95758

( * ) Notice: Subject to any disclaimer, the term of this patent is extended or adjusted under 35 U.S.C. 154(b) by 102 days.

(21) Appl. No.: 12/328,172

(22) Filed: Dec. 4, 2008

(51) Int. Cl.
*B02C 19/00* (2006.01)

(52) U.S. Cl. ..... 241/199.12; 241/DIG. 27

(58) Field of Classification Search ..... 241/DIG. 27, 241/199.12, 282.1, 282.2
See application file for complete search history.

(56) References Cited

U.S. PATENT DOCUMENTS 2,602,596 A 7/1952 Jones et al.
3,915,393 A 10/1975 Elkins
4,003,523 A 1/1977 Doolittle
4,111,372 A 9/1978 Hicks et al.
D260,350 S 8/1981 Kahlcke
4,469,283 A * 9/1984 Noguchi et al. ..... 241/48
D347,966 S 6/1994 Doggett
6,824,087 B2 * 11/2004 McPherson et al. ..... 241/30
7,703,712 B2 * 4/2010 Chiu et al. ..... 241/100
2002/0031047 A1 3/2002 Fromm
2007/0051838 A1 3/2007 Yehiayan et al.

* cited by examiner

*Primary Examiner*—Mark Rosenbaum

(57) ABSTRACT

A medicine crushing device for grinding medication tablets comprising a housing having a top half and a bottom half separated by an inner wall. The top half is for holding the medication tablets. A cap is removably attached to the top of the top half of the housing, a motor is disposed in the bottom half of the housing, and one or more blades operatively connected to the motor are disposed in the top half of the housing.

2 Claims, 3 Drawing Sheets

MEDICINE CRUSHER

FIELD OF THE INVENTION

The present invention is directed to a device for crushing medicine tablets.

BACKGROUND OF THE INVENTION

The present invention features a medicine crushing device for grinding medication tablets. The medicine crushing device comprises a housing having a top half and a bottom half separated by an inner wall. The top half is for holding the medication tablets. A cap is removably attached to the top of the top half of the housing. The medicine crushing device further comprises one or more blades for grinding the medication table disposed in the top half of the housing, wherein the blade is connected to a motor disposed in the bottom half of the housing. In some embodiments, a button for turning the motor on or off is connected to the motor and is disposed on the outside surface of the housing.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
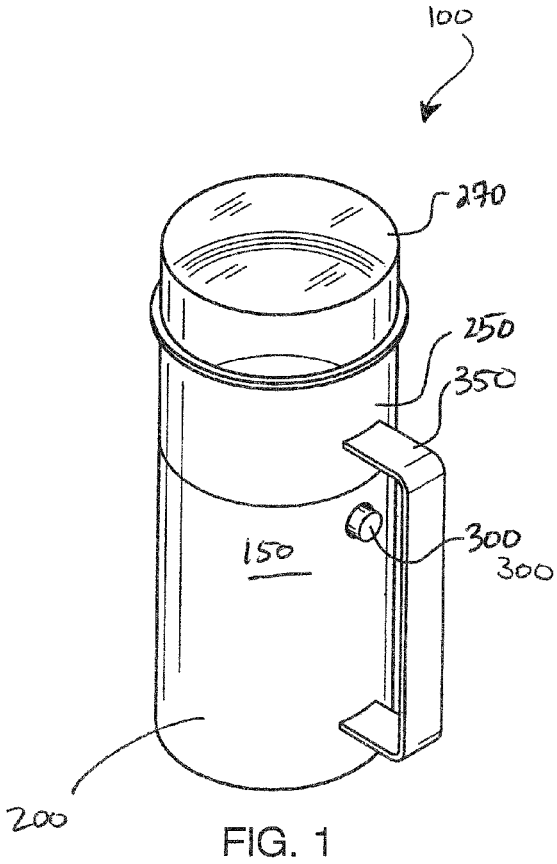
FIG. 1 is a perspective view of the medicine crushing device of the present invention.
Figure 2:
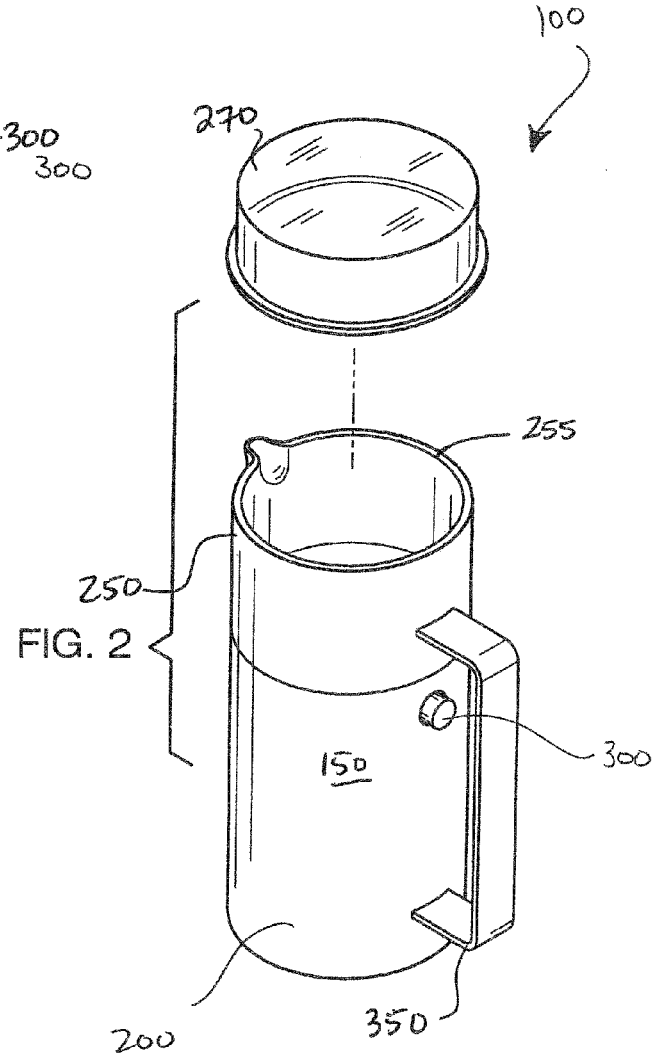
FIG. 2 is a perspective view of the medicine crushing device of FIG. 1.
Figure 3:
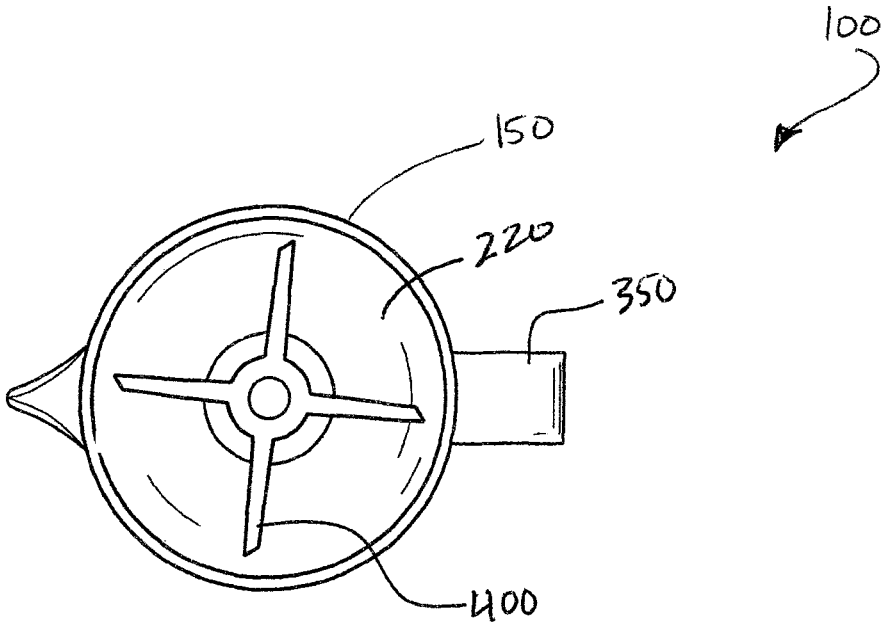
FIG. 3 is a top view of the medicine crushing device of FIG. 1.
Figure 4:
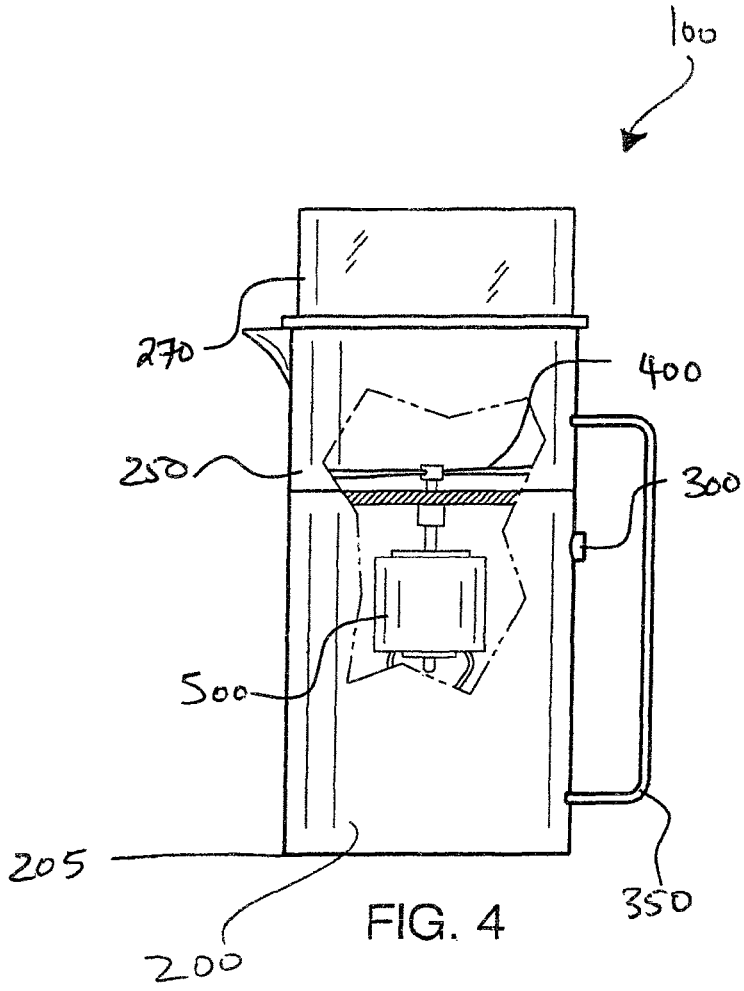
FIG. 4 is a side view of the medicine crushing device of FIG. 1.
Figure 5:
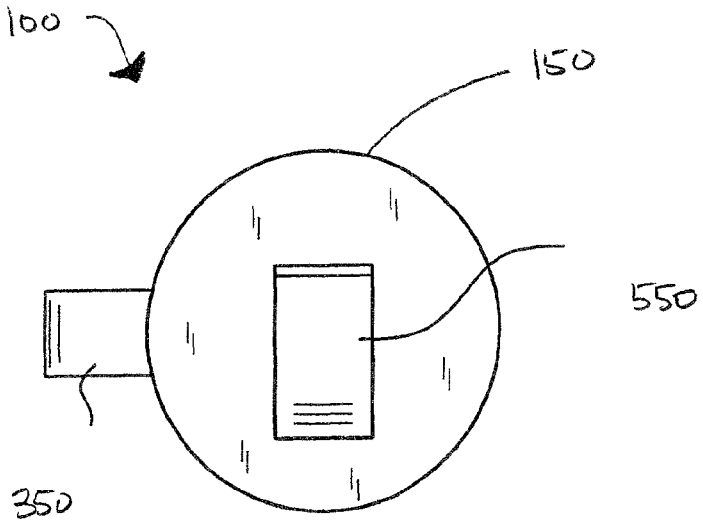
FIG. 5 is a bottom view of the medicine crushing device of FIG. 1.
Figure 6:
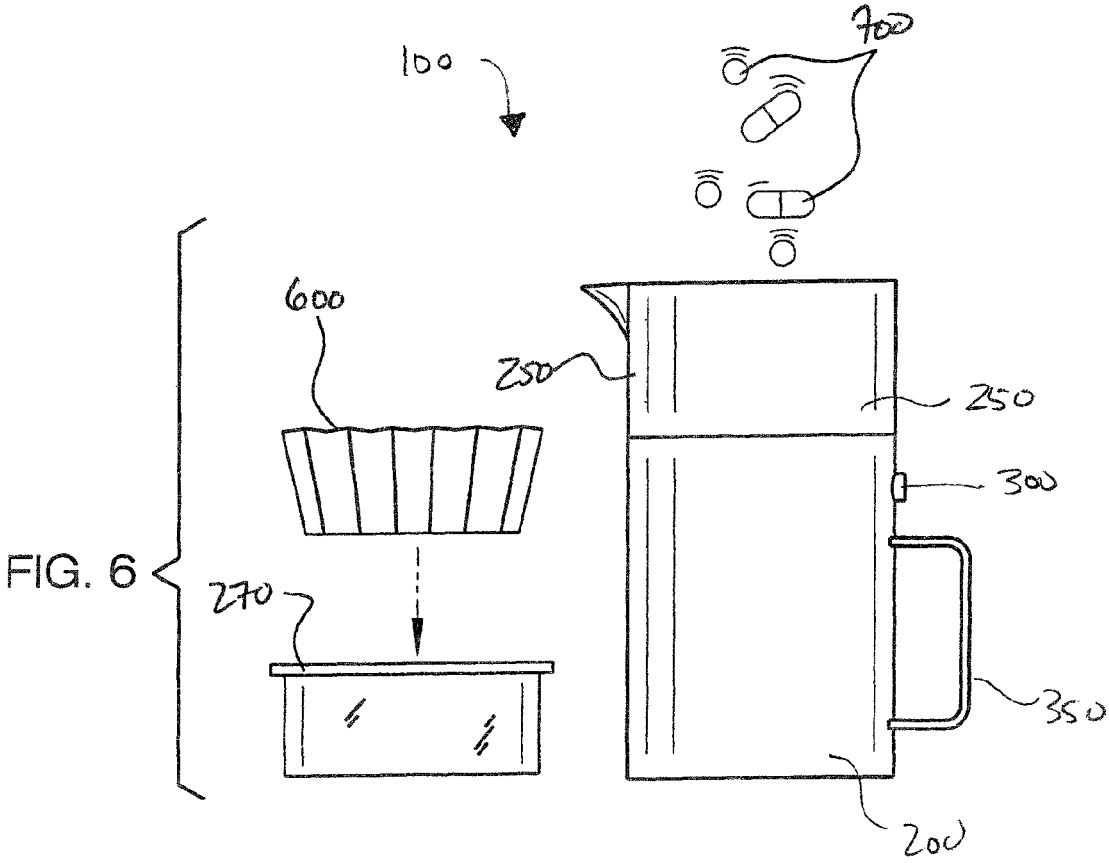
FIG. 6 is a side view of the medicine crushing device of FIG. 1.

The following is a listing of numbers corresponding to a particular element refer to herein:

100 medicine crushing device
150 housing
200 bottom half of housing
205 bottom of bottom half of housing
220 inner wall of housing
250 top half of housing
255 top of top half of housing
270 cap
300 button
350 handle
400 blade
500 motor
550 battery compartment
600 filter
700 medication tablet Referring now to FIGS. 1-6, the present invention features a medicine crushing device 100 for grinding medication tablets 700. The medicine crushing device 100 comprises a housing 150 having a top half 250 and a bottom half 200 separated by an inner wall 220. The top half 250 is for holding the medication tablet 700. The top half 250 has an open top 255, an outside surface, and an inside. The bottom half 200 has a bottom 205, an outside surface, and an inside.

A cap 270 is removably attached to the top 255 of the top half 250 of the housing 150. One or more blades 400 for grinding the medication tablet 700 is disposed in the top half 250 of the housing 150. A motor 500 is disposed in the bottom half 200 of the housing 150. The motor 500 is electrically/operatively connected to the blades 400 disposed in the top half 250 of the housing 150.

In some embodiments, a button 300 for turning the motor 500 on or off is disposed on the outside surface of the bottom half 200 of the housing 150. In some embodiments, a button 300 for turning the motor 500 on or off is disposed on the outside surface of the top half 250 of the housing 150. The button 300 is electrically/operatively connected to the motor 500.

In some embodiments, a handle 350 is disposed on the outside surface of the top half 250 of the housing 150 and/or the outside surface of the bottom half 200 of the housing 150.

In some embodiments, the cap 270 is removably attached to the top 255 of the top half 250 of the housing 150 via an attachment means. In some embodiments, the attachment means includes a screw mechanism, a hinge mechanism, a snap mechanism, the like, or a combination thereof.

In some embodiments, a fitter 600 may be inserted into the top half 250 of the housing 150. In some embodiments, a filter 600 is inserted into the top half 250 of the housing 150, and the medicine tablet 700 is inserted into the filter 600. In some embodiments, the cap 270 is removed from the top half 250 of the housing 150 and a filter 600 is inserted into the cap 270. In some embodiments, the remains of the medication tablet 700 after it has been ground are poured from the top half 250 of the housing 150 into the filter 600 disposed in the cap 270. In some embodiments, the filter 600 is removed and replaced with a new fitter 600 in between uses.

In some embodiments, the motor 500 is powered by a battery or a household current. In some embodiments, the battery is a 9-volt battery. In some embodiments, an electrical cord connects the motor 500 to the household current. In some embodiments, the electrical cord is between about 3 to 4 feet in length.

The medicine crushing device 100 of the present invention may be constructed from a variety of materials. For example, in some embodiments, the housing 150 is constructed from a material comprising a plastic, a rubber, a metal, the like, or a combination thereof. In some embodiments, the top half 250 is constructed from a material comprising a stainless steel.

The medicine crushing device 100 of the present invention may be constructed in a variety of shapes and/or sizes. For example, in some embodiments, the housing 150 is cylindrical. In some embodiments, the housing 150 is rectangular, oval, the like, or a combination thereof.

As used herein, the term "about" refers to plus or minus 10% of the referenced number. For example, an embodiment wherein the medicine crushing device 100 is about 10 inches in height includes a medicine crushing device 100 that is between 9 and 11 inches in height.

In some embodiments, the housing 150 is between about 3 to 5 inches in diameter. In some embodiments, the housing 150 is between about 5 to 8 inches in diameter.

In some embodiments, the housing 150 is between about 4 to 8 inches in height as measured from the top 255 of the top half 250 of the housing 150 to the bottom 205 of the bottom half 200 of the housing 150. In some embodiments, the housing 150 is between about 8 to 12 inches height as measured from the top 255 of the top half 250 of the housing 150 to the bottom 205 of the bottom half 200 of the housing 150.

Example 1

Use of the Medicine Crushing Device

The following example describes the use of the medicine crushing device 100 of the present invention. First, a user plugs the medicine crushing device 100 into an electrical outlet in his home. Next, he unscrews the cap 270 from the top half 250 of the housing 150 and places his medicine tablets 700 into the top half 250. After screwing the cap 270 back onto the top half 250 of the housing 150, the user pushes the button 300 to turn the motor 500 on, which activates the blades 400. The blades 400 crush the tablet 700; when the tablets 700 are sufficiently ground, the user pours the remains of the tablets 700 out of the top half 250 of the housing 150 into his beverage.

The following the disclosures of the following U.S. Patents are incorporated in their entirety by reference herein: U.S. Pat. No. 4,003,523; U.S. Pat. No. 2,602,596; U.S. Pat. No. 3,915,393; U.S. Pat. No. 4,111,372.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A medicine crushing device for grinding a medication tablet, said medicine crushing device comprising:

(a) a housing having a top half and a bottom half separated by an inner wall; wherein the top half is for holding the medication tablet, wherein the top half has an open top, an outside surface, and an inside; wherein the bottom half has a bottom surface, an outside surface, and an inside;

(b) a cap removably attached to the top of the top half of the housing;

(c) one or more blades for grinding the medication tablet disposed in the top half of the housing extending upwardly from a top surface of the inner wall of the housing, the inner wall is closed such that material from the top half cannot pass to the bottom half;

(d) a motor disposed in the bottom half of the housing, wherein the motor is operatively connected to the blades disposed in the top half of the housing; and (e) a button for turning the motor on or off, wherein the button is disposed on the outside surface of the bottom half of the housing, wherein the button is electrically connected to the motor; and a filter is inserted into the top half of the housing to hold the medication tablet.

2. A medicine crushing device for grinding a medication tablet, said medicine crushing device comprising:

(a) a housing having a top half and a bottom half separated by an inner wall; wherein the top half is for holding the medication tablet, wherein the top half has an open top, an outside surface, and an inside; wherein the bottom half has a bottom surface, an outside surface, and an inside;

(b) a cap removably attached to the top of the top half of the housing;

(c) one or more blades for grinding the medication tablet disposed in the top half of the housing extending upwardly from a top surface of the inner wall of the housing, the inner wall is closed such that material from the top half cannot pass to the bottom half;

(d) a motor disposed in the bottom half of the housing, wherein the motor is operatively connected to the blades disposed in the top half of the housing; and (e) a button for turning the motor on or off, wherein the button is disposed on the outside surface of the bottom half of the housing, wherein the button is electrically connected to the motor; and a filter is inserted into the cap to hold the medication tablet.

* * * * *